US005079899A

United States Patent [19]

Kurachi

[11] Patent Number: 5,079,899

[45] Date of Patent: Jan. 14, 1992

[54] BAND REEL REPLACING AND BAND LOADING METHOD AND APPARATUS

[75] Inventor: Hiroshi Kurachi, Toda, Japan

[73] Assignee: Strapack Corporation, Tokyo, Japan

[21] Appl. No.: 630,459

[22] Filed: Dec. 19, 1990

[51] Int. Cl.[5] ..... B65B 13/04

[52] U.S. Cl. ..... 53/399; 53/505; 53/589; 242/58

[58] Field of Search ..... 53/588, 589, 590, 582, 53/399, 64, 505, 506; 242/167, 159, 58.4, 58

[56] References Cited

U.S. PATENT DOCUMENTS

| | | | |
|---|---|---|---|
| 2,752,985 | 7/1956 | Aldrich | 242/58.4 X |
| 4,159,807 | 7/1979 | Honsel et al. | 242/58 X |
| 4,466,577 | 8/1984 | Focke et al. | 242/58 |
| 4,509,415 | 4/1985 | Stobb | 53/589 X |
| 4,872,939 | 10/1989 | McVay et al. | 242/58 X |
| 4,885,901 | 12/1989 | Sakaki et al. | 53/589 |
| 4,955,180 | 9/1990 | Sakaki et al. | 53/589 X |

*Primary Examiner*—James F. Coan
*Attorney, Agent, or Firm*—Joseph C. Mason, Jr.; Ronald E. Smith

[57] ABSTRACT

A band strapping machine having more than one supply reel and having a mechanism that automatically loads a band from a second supply reel when a first supply reel becomes empty. The trailing end of a band from the first band reel is grabbed so that it is not introduced into the machine's pool box and the band previously accumulated in the pool box is fed through the machine and used to accomplish a final strapping operation. The part of the band not needed to complete the final strapping operation is ejected from the machine by reverse rotation of a pool roller. The leading end of the replacement band is then gripped and a band guide unit moves into position to guide the replacement band through the machine's band guide arch to the machine's feed unit. Once the leading end of the replacement band has attained a preselected position, a coveyor line carrying articles to be strapped is re-started and a package is strapped with the band in the band guide arch. The band guide then retracts, the pool roller rotates to again fill the pool box, and the machine's normal strapping operation resumes. An operator changes the empty reel while the machine is operating.

17 Claims, 7 Drawing Sheets

BAND REEL REPLACING AND BAND LOADING METHOD AND APPARATUS

BACKGROUND OF THE INVENTION

1. Field of the Invention

This invention relates, generally, to improvements in band strapping machines. More particularly, it relates to a method and apparatus for quickly replacing an empty band reel with a full band reel to minimize the down time of a conveyor line during reel changes.

2. Description of the Prior Art

Strapping machines are used, as their name implies, to wrap flexible metallic bands around packages or other containers. The containers are usually delivered to the strapping machine on a conveyor means to enable continuous operation of the strapping machine. The band is coiled on a large, rotatably mounted supply reel which must be replaced when it is empty. All of the known strapping machines currently in use have but one supply reel, and it is a time-consuming chore to change the reel when it becomes empty. Therefore, the conveyor line must be stopped during the reel change and this, of course, adversely affects productivity.

More specifically, when the supply reel of an existing machine becomes empty, the conveyor means delivering packages thereto must be stopped, and the operator of the strapping machine must wait for the empty supply reel to coast to a stop. Once the empty supply reel has stopped rotating, the operator must remove that reel and replace it with a full reel. The leading end of the new reel must then be threaded through the machine until it reaches a point where the machine can be re-started. Thus, the conveyor means is shut down for a considerable period of time every time a supply reel becomes empty.

Many inventors have improved the known machines in an effort to make them work better. There have been so many refinements over the years that the conventional wisdom in this art is that the major developments in this field have already been made and that the strapping machines of the future will merely be refined versions of the existing machines.

For example, the size of the supply reels has been increased so that the time interval between reel changes is increased. Moreover, operators have been trained to handle the reel changing procedure in a fast, efficient manner. The operators have also been provided with new tools to help them accomplish their task. Thus, the teachings of the prior art suggest to those of ordinary skill in this field that more effort should be made in the direction of means for changing the reels more quickly, but how that goal could be accomplished is not obvious.

SUMMARY OF THE INVENTION

The longstanding but heretofore unfulfilled need for a breakthrough in the technology of strapping machines is now fulfilled by a strapping machine having two or more supply reels and automatic means for switching from an empty reel to a full reel. Moreover, the novel machine further includes means for strapping a package during the time the machine is switching from the empty reel to the full reel so that the conveyor means delivering packages to the novel machine need not be stopped for any substantial amount of time.

The leading end of each band of at least a pair of bands is introduced into a pool roller box so that each leading end is disposed between a pool roller and an associated touch roller. However, the touch rollers are positioned on diametrically opposite sides of the pool roller, are eccentrically mounted, and are linked together by a pivotal link member so that only one touch roller may touch the pool roller at a time and thus grippingly engage the leading end of a band. When the first touch roller is in engagement with the first band, rotation of said first touch roller allows the first band to travel through the machine along a predetermined path of travel, but the second band will not travel. The second band cannot travel until the link member pivots, thereby disengaging the first touch roller from the pool roller and engaging the second.

When a first reel becomes empty, the trailing end of the band leaving that reel is detected by a first detector and a first signal is generated to activate a solenoid that grabs that trailing end before it is deposited into a pool box. Even though a first supply reel is now empty and the second supply reel has not yet been fully introduced into the machine, the strapping cycle in progress when the first reel became empty is completed by using band previously accumulated in the pool box for that purpose. After the passage of a predetermined amount of time, the solenoid releases the band and a motor that controls the direction of band travel reverses its direction of rotation and the trailing end of that band becomes the leading end as the excess band not needed to complete the aforementioned strapping cycle is drawn from the pool box and ejected from the machine.

When all of the excess band has been drawn from the pool box, the trailing end of said excess band is detected by a second detector, indicating that the ejection is complete, and a second signal is generated by said second detector that stops reverse rotation of the pool roller, toggles the touch rollers so that the leading end of the replacement band is gripped between the pool roller and its associated touch roller, and moves a band guiding device from a retracted position into its operative position for guiding the leading end of the replacement band from a second supply reel from the pool roller directly to a feed roller, bypassing the pool box.

The reverse rotation of the pool roller empties the pool box and a third detector in the pool box generates a "box empty" signal that re-starts rotation of the pool roller in its first, or forward direction. However, since the band guide device is now "in" as aforesaid, the forward rotation of the pool roller feeds the replacement band to the feed unit of the machine, bypassing the pool box as aforesaid.

A fourth detector generates a fourth signal to confirm that the band guide device is in its "in" position, and that fourth signal re-starts rotation of the machine's feed rollers so that the leading end of the replacement band begins traveling through the machine. That replacement band is routed through the band guide arch of the machine to a predetermined station in the feed unit of the machine.

When the leading end of the replacement band arrives at said predetermined station in the feed unit of the machine, a fifth detector at that location generates a fifth signal, indicating the arrival of the leading end of said second band at that predetermined station and therefore indicating that an amount of band sufficient to wrap an article is now positioned in the band guide arch so that a strapping operation can begin immediately upon receipt of said fifth signal. That fifth signal also causes the return of the band guiding device to its retracted or "out" position. The fifth signal also re-starts the conveyor line and causes an article to be strapped with the amount of band in the band guide arch of the machine.

A sixth detector generates a "band guide out" signal when said retracted position has been attained. The pool roller rotates again in its first direction, in response to receipt of said "band guide out" signal, to introduce a predetermined amount of the second band into the pool box.

A seventh detector in the machine's pool box generates a seventh signal when the pool box is again full, and that signal resumes normal operation of the machine, although it should be understood, as aforesaid, that the strapping operation had resumed upon generation of said fifth signal.

The machine operator then has ample time to replace the empty reel and to place the leading end of the replacement band in position between the pool roller and the disengaged touch roller while the machine is running. When the second supply wheel becomes empty, the above-described automatic procedure is repeated.

It should be understood from the outset that the pool box, mentioned above, is a receptacle into which a predetermined amount of band is accumulated before the band is routed to the arched part of the machine where the conventional strapping operation takes place. Thus, when the first supply reel is hooked up, the leading end of the band coiled thereabout is threaded through band passageways that carry the band through a pool roller assembly having rollers thereon capable of rotating in opposite directions. Thus, the direction of rotation of these rollers determines the direction of band travel. When the leading end of the band is threaded through those rollers, a band guide device is needed to guide said leading end to a feed roller in the machine's feed unit. Rotation of the pool roller in a forward direction while the feed roller is not rotating causes the band to enter the pool box. A balance bar in the tool box shuts off rotation of the pool roller when it determines that the correct amount of band has accumulated in the box.

When all of the band on a supply reel has become used, i.e., only when a reel becomes empty, the accumulated length of band in the pool box is used for the final strapping operation associated with that reel. The accumulated amount will be sufficient to perform that final strapping operation, but there will be some excess band that is not used. The reverse rotation of the pool roller draws that excess band from the pool box so that band from the second reel can be fed into the machine by the band guiding device that deploys into its operative position only when the excess band has been ejected. The band guiding device comes into play only when the pool box is empty. The balance bar in the pool box includes limit switch means for determining whether the pool box is empty or full. If it is empty, a limit switch member sends a signal to the motor that controls rotation of the pool roller. When the pool box is full, a different limit switch member sends a signal to the motor that drives the pool roller to stop rotation of the pool roller. It should be understood, however, that when the machine is operating in its normal strapping mode, the feed roller in the machine's feed unit and the pool roller will rotate cooperatively to maintain the desired amount of band in the pool box. Thus, the feed unit continues to rotate for a predetermined amount of time after a supply reel has become empty but the pool roller does not so that the accumulated band is used up in said final strapping step.

There are a total of seven detecting devices in the novel machine, as follows: the first detector detects the trailing end of a band when a supply reel becomes empty. The second detector detects the trailing end of the excess band that is traveling in a reverse direction as it is being ejected from the machine. A third detector, in the machine's pool box, detects when the pool box is empty. A fourth detector indicates that the band guide is in its "in" position. A fifth detector detects the presence of the leading end of the replacement band at a predetermined location in the feed unit of the machine so that the band guiding device can be retracted, and a sixth detector detects the "out" or retracted position of the band guiding device. The seventh detector is associated with the pool box and detects when said pool box is full.

The primary object of this invention is to provide a strapping machine having at least two supply reels and means for strapping a package even during the time reels are being changed so that conveyor line down time is minimized.

A related object is to provide a unique mechanism for feeding a band into a pool box by reversible means so that excess band from a first reel can be withdrawn from the pool box when needed to allow insertion of a second band thereinto.

Still another object is to provide a semi-automatic machine having detectors strategically located thereon to sense the operating mode of the machine and to change its mode of operation as needed without human intervention.

These and many other objects, features, and advantages of this invention will become apparent as this disclosure continues.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

The Pool Box

Figure 3:
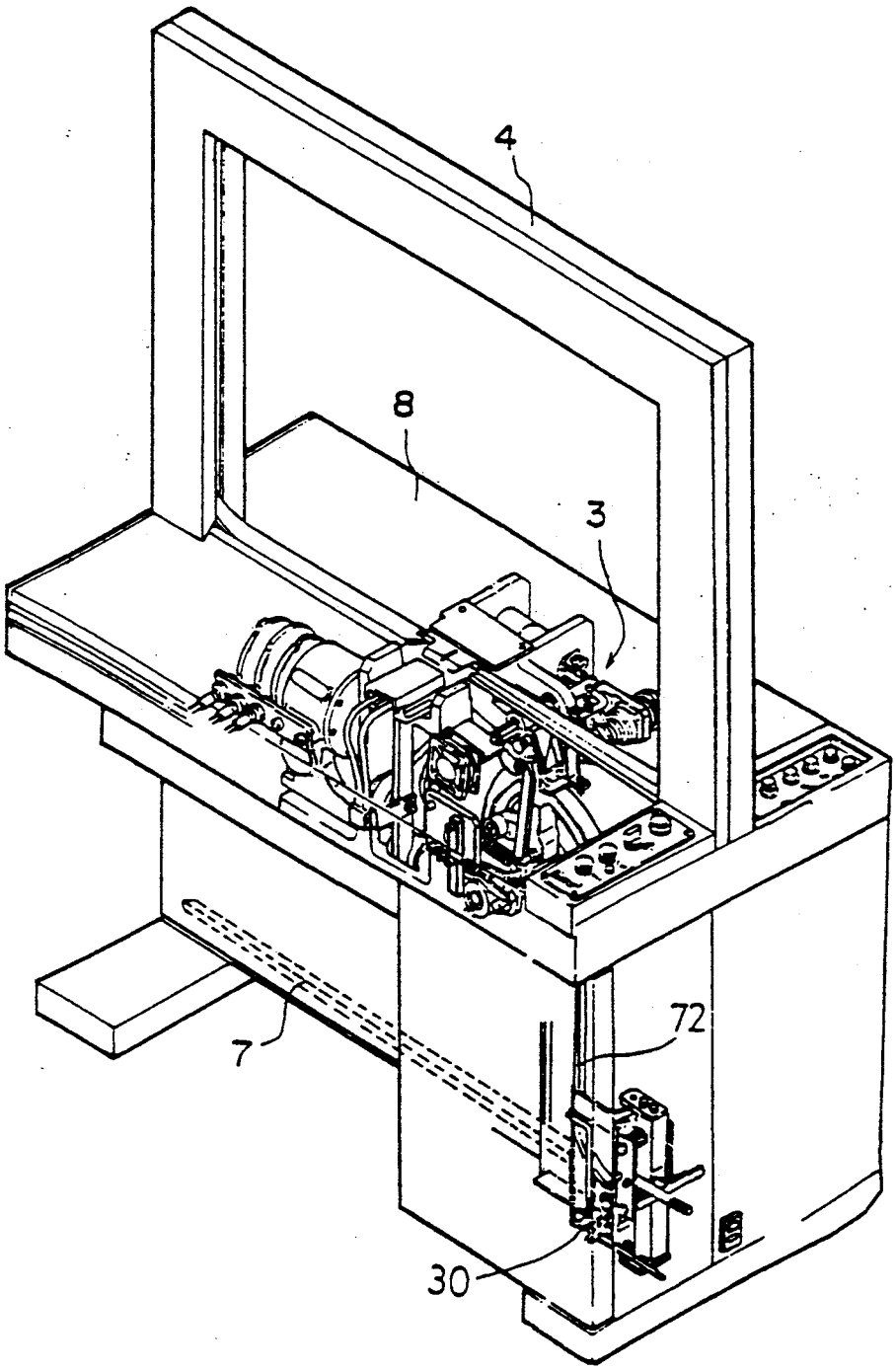
FIG. 3 : a perspective view of the novel strapping machine.

Referring first to FIG. 3, it will there be seen that a pool unit 30 is positioned adjacent a band inlet of a pool box 2. Pool box 2 is a receptacle for accumulating a predetermined length of band prior to feeding that band to a band guiding arch 4 that is bridged over working table 8 of the novel strapping machine 1. Feed unit 3 drives the band through said arch 4.

Figure 5:
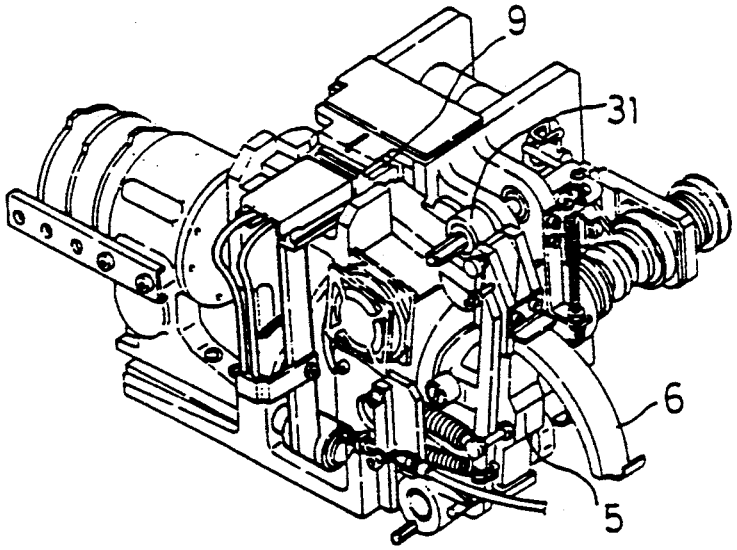
FIG. 5 is a perspective view of the novel feed unit.

As best shown in FIG. 5, a band tightening tension arm 5 is provided adjacent to feed roller 31 of feed unit 3, and an arm chute 6 is attached to tension arm 5. Two band reels, not shown in FIG. 3, are provided at the side of pool unit 30 of machine 1.

Balance bar 7 detects whether or not an adequate amount of band is accumulated in pool box 2 according to the weight of the band. An adequate amount of band is the amount needed to strap a package during a time interval that begins when a first supply reel becomes empty and a second supply reel is brought into operation. Note that the balance bar 7 is positioned below pool box 2. A "box empty" limit switch, not shown, is mounted at the free end of balance bar 7, and that limit switch controls operation of a motor that drives pool unit 30. When the "box empty" limit switch of the balance bar 7 detects that the pool box 2 is empty, pool roller 55 of the pool unit 30 is rotated in a first direction to feed band into the pool box, as will be shown in detail hereinafter. When a reel is being changed and the band accumulated in the pool box is needed to strap a box to avoid lengthy shut down of the conveyor means, the motor of the pool unit does not rotate. Thus, the accumulated band is used up during the final strapping step associated with the reel to be replaced. However, the amount of band in the pool box may not be exactly equal to the amount needed to complete the final strapping step, so means are provided to eject such excess band from the pool box, as will be more fully set forth hereinafter.

A "box full" limit switch, also not shown, is activated when a predetermined amount of band has accumulated within pool box 2. As will become more clear as this description proceeds, when the pool box is full, that limit switch generates a signal that stops rotation of the pool roller.

The Band Guide Member

Figure 4:
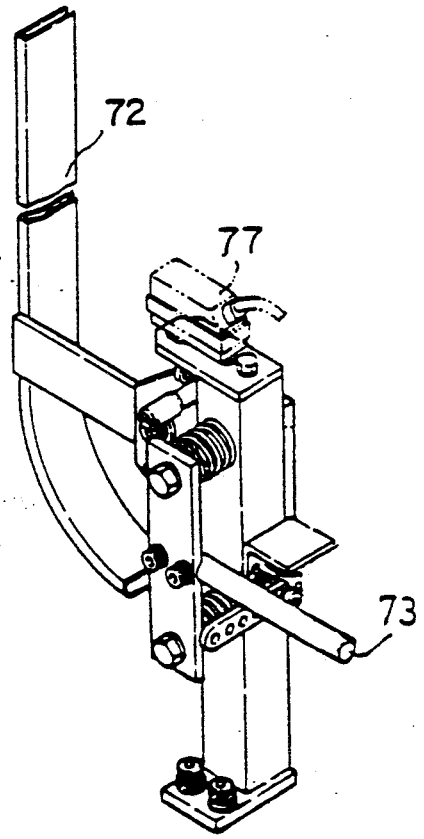
FIG. 4 is a perspective view of the novel band guide.

When a replacement band is being introduced into the machine, a band guide member 72, shown in FIG. 4, is needed to deliver the leading end of said replacement band from a second supply reel to its operating position in machine 1. As shown in FIG. 4, band guide 72 has lever 73 including an actuator such as an air cylinder or a solenoid, not shown, for positioning the band in its "in" or "out" position. When band guide 72 is "in," it guides the band from pool unit 30 directly to the feed unit 3, thereby bypassing pool box 2. A limit switch 77 (FIG. 4) constitutes signal generating means for detecting whether the band guide is situated in its band guiding position or "in" position or its retracted, "out" position. The band guide 72 has a U-shaped cross section to facilitate removal of the band from its guided position when the band pooling is started.

The Reel Members

Figure 2:
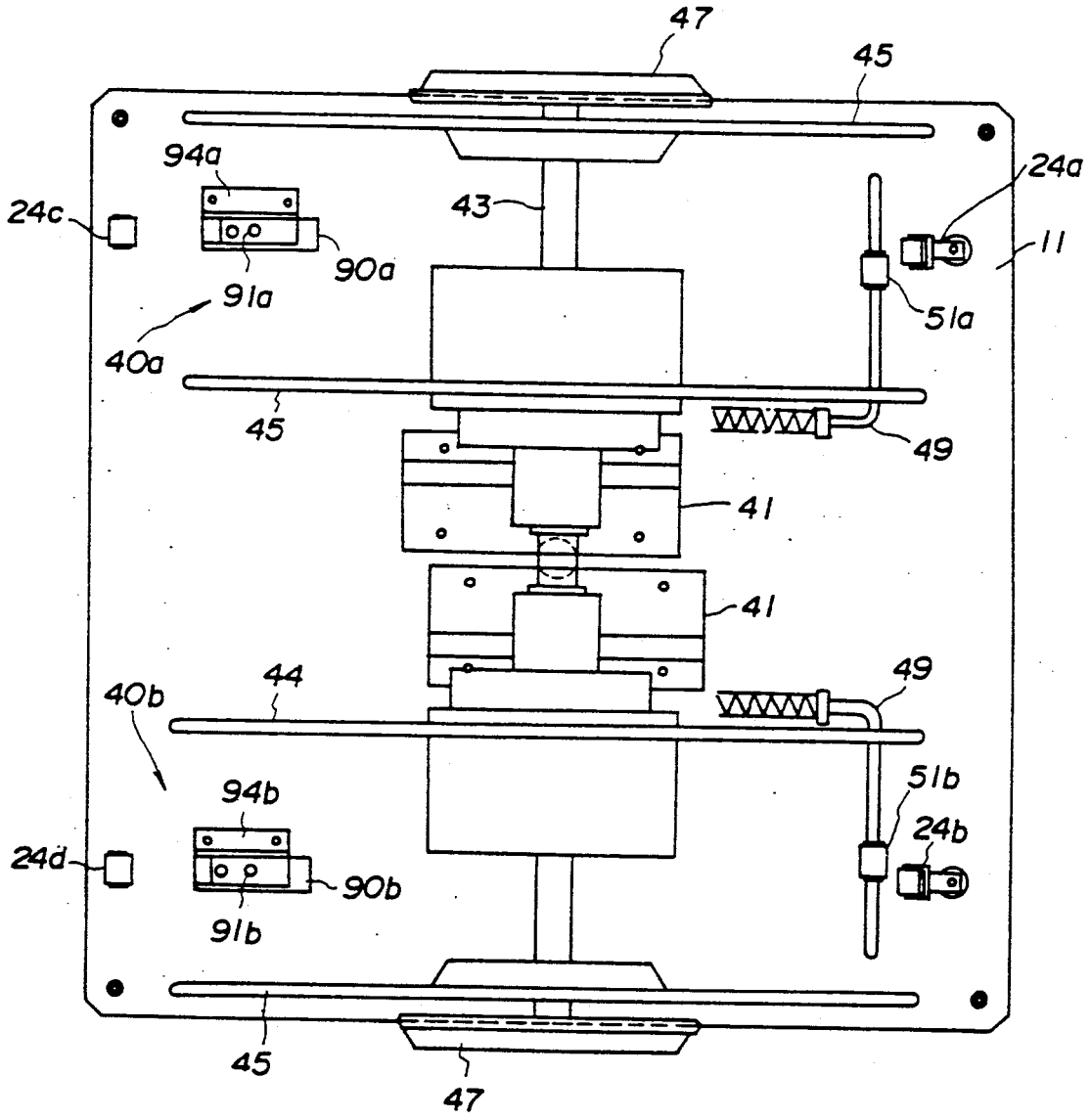
FIG. 2(A) is a plan view of the novel reel unit.
FIG. 2(B) is a side elevational view of the reel unit shown in FIG. 2(A)
Figure 2:
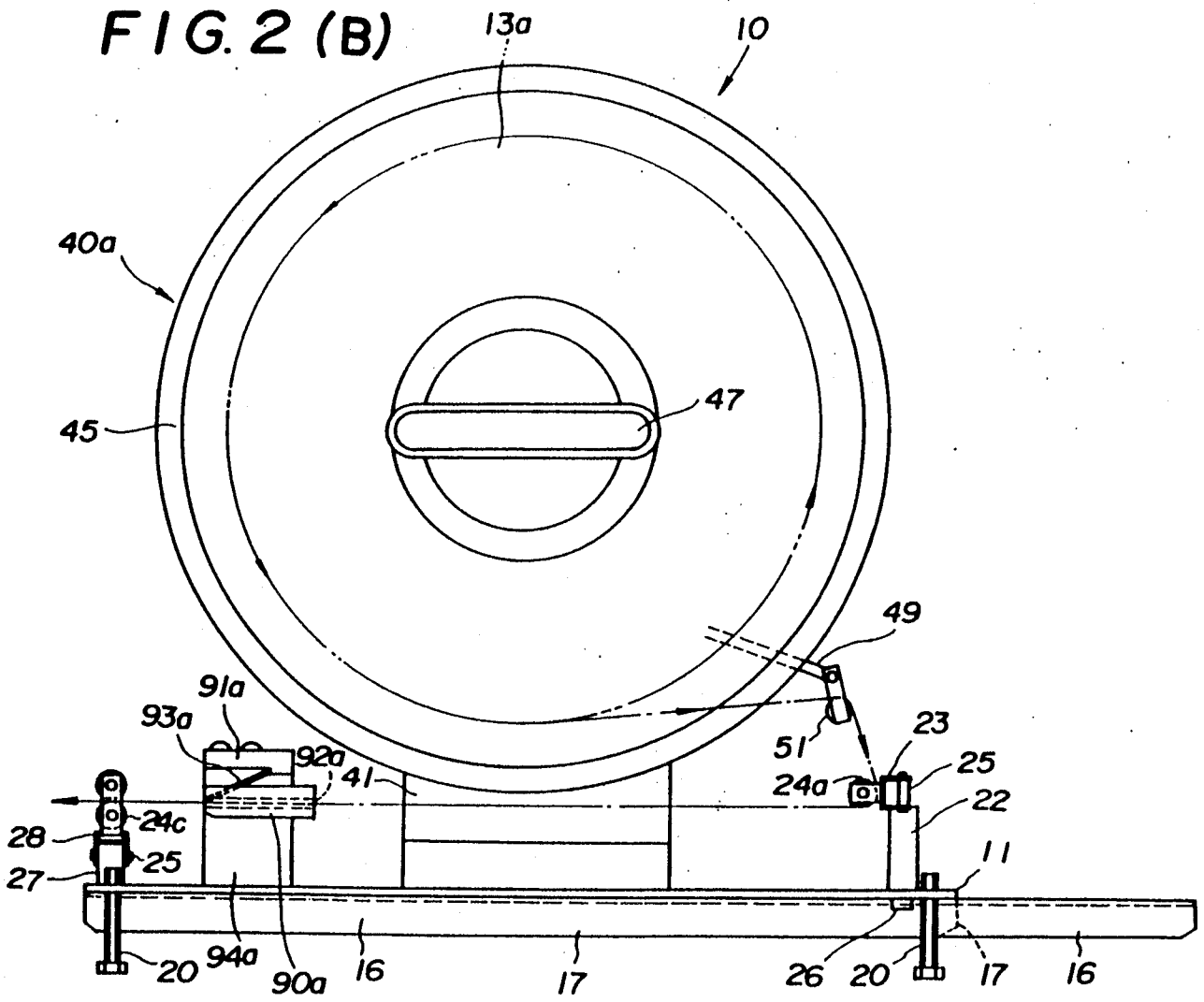

FIGS. 2(A) and 2(B) show a reel unit 10 having two band reels installed on a platform 11.

Platform 11 has a flat upper surface and a reinforcing angle bar 17 supports the lower surface thereof. Platform 11 is clamped at four positions with bolts 20. Rotation of the bolts adjusts the height or affects the level of said platform.

Band guide rollers 24*a*–24*d* are provided on the upper surface of the platform on an imaginary line bisecting band reels 40*a* and 40*b*. A band coil 13 is mounted between a reel inner plate 44 and a reel outer plate 45 of each band reel to guide the band drawn from said band reels 40*a* and 40*b* to a pool chute 70 of the strapping machine body 1. The band guide rollers 24*a*and 24*b* are positioned adjacent reel brake arms 49 of the band reels 40*a* and 40*b* so as not to interfere with the free slide rollers 51 of said reel brake arms 49. Band guide rollers 24*a* and 24*b* are clamped at the lower ends thereof with screws 26 to a roller bracket 23 that is pivotally secured by a pin 25 to the upper end of a holder 22 mounted on platform 11.

Band guide rollers 24*c* and 24*d* have two rollers, i.e., one upper and one lower roller, and said rollers are pivotally secured to a double roller bracket 28 that is pivotally secured by pin 25 to the upper end of a holder 27 by clamping the band guide rollers 24*a* and 24*b* with screws at the lower positions at symmetrical positions through the band reels 40*a* and 40*b*.

Figure 6:
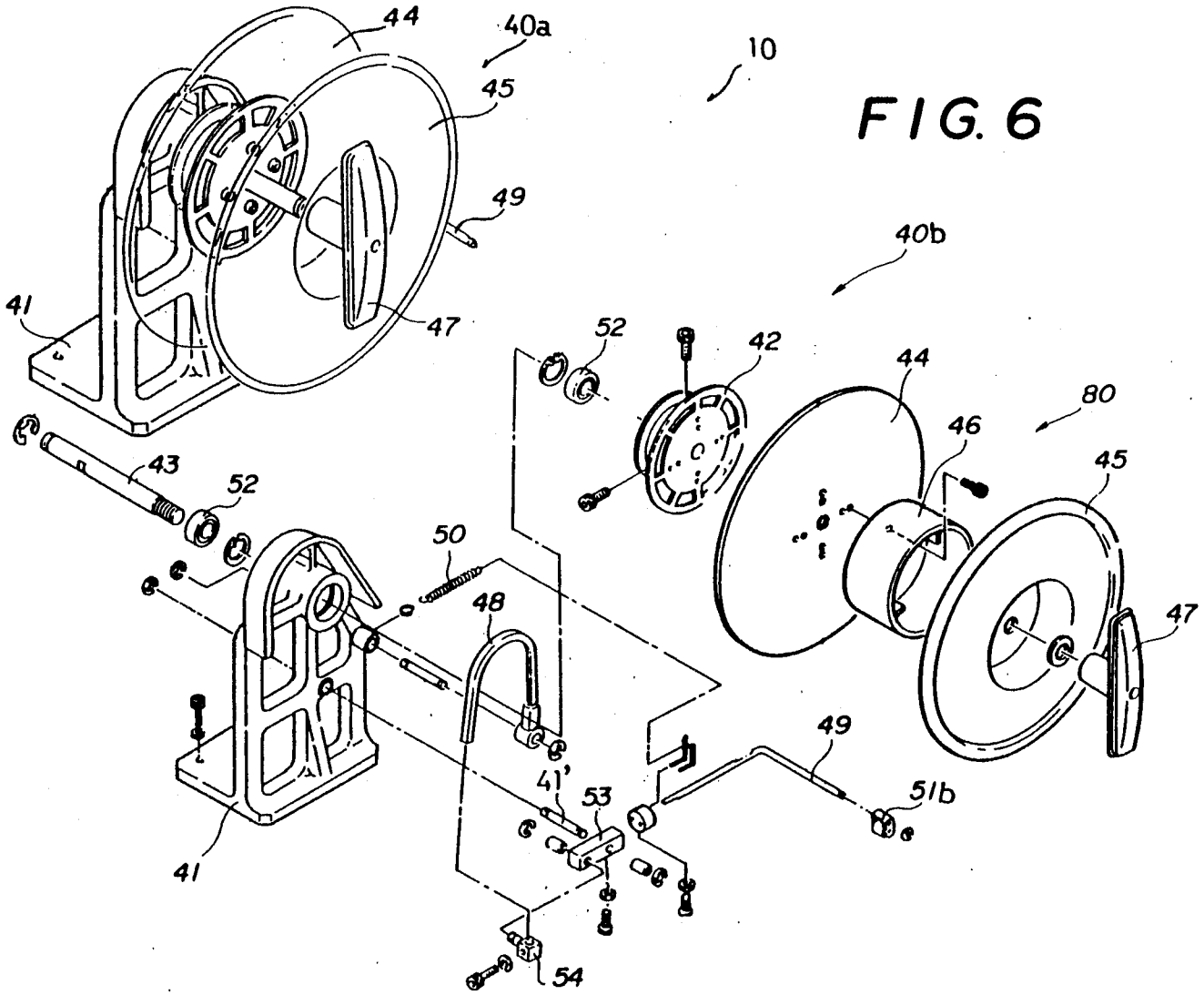
FIG. 6 is an exploded perspective view of a novel reel member.

In FIG. 6, band reels 40*a* and 40*b* are clamped with screws by engaging a reel bracket pulley 42 secured with screws with the reel inner plate 44 and the reel outer plate 45 to a reel shaft 43 by supporting the reel shaft 43 by a bearing 52 through a bore 52*a* formed in the upper end of reel unit base 41.

A first end of brake belt 48 is secured to reel unit base 41 as shown in FIG. 6 and is positioned in a V-shaped groove of the reel bracket pulley 42. The second end of brake belt 48 is pivotally secured to a first side of a brake tension holder 53 through belt clamping fittings 54. The brake tension holder 53 is secured at its center to a shaft 41 that extends through the reel unit base 41. A first end of a reel brake arm 49 is secured to a second side of the brake tension holder 53, and a spring 50 attached to a preselected position of the reel brake arm 49 urges brake belt 48 into the V-shaped groove of the reel bracket pulley 42. The free slide roller 51 is movably attached to the end of reel brake arm 49. The reel outer plate 45 is rotatably mounted to reel shaft 43 and a reel nut handle 47 screw threadedly engages the threaded end of shaft 43 and thus holds the reel unit together.

The Pool Roller

Figure 1:
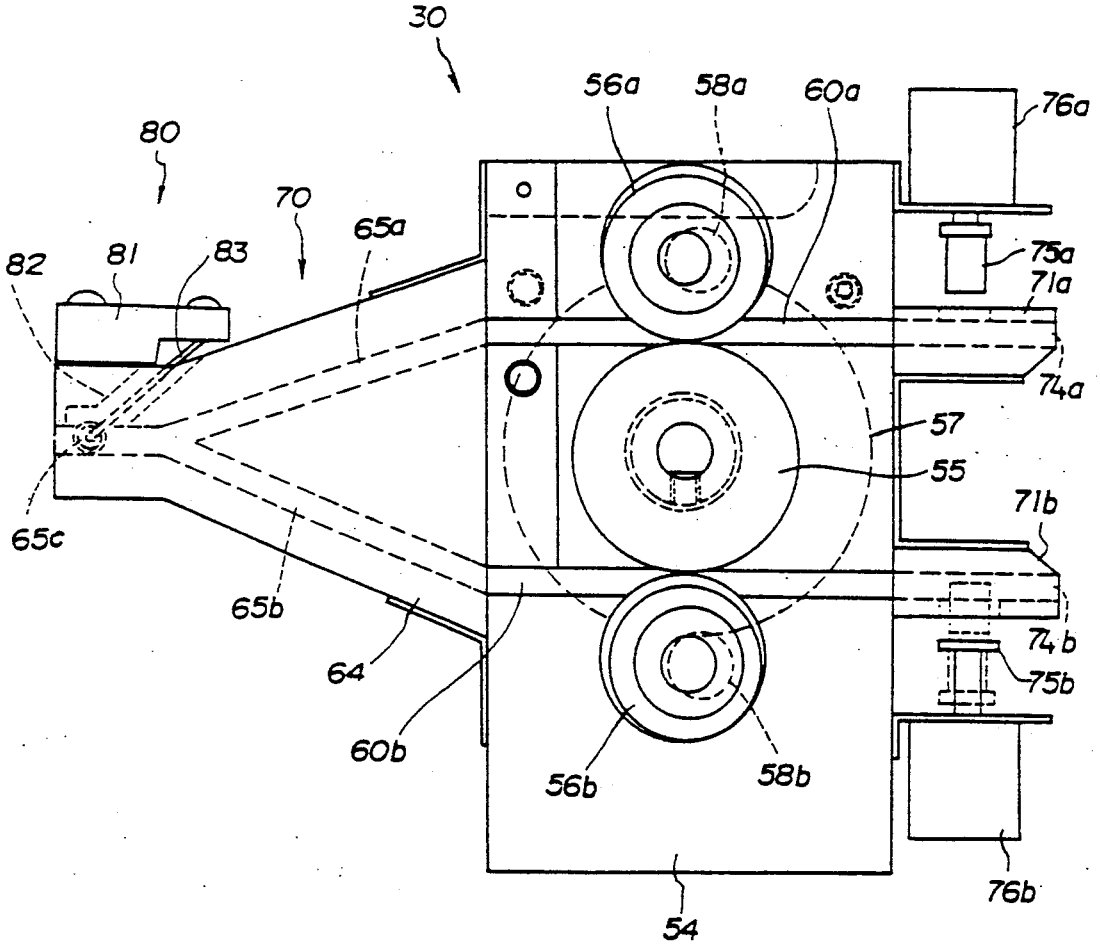
FIG. 1(A) is a front elevational view of the novel pool unit.
FIG. 1(B), is a rear elevational view of said pool unit.
Figure 1:
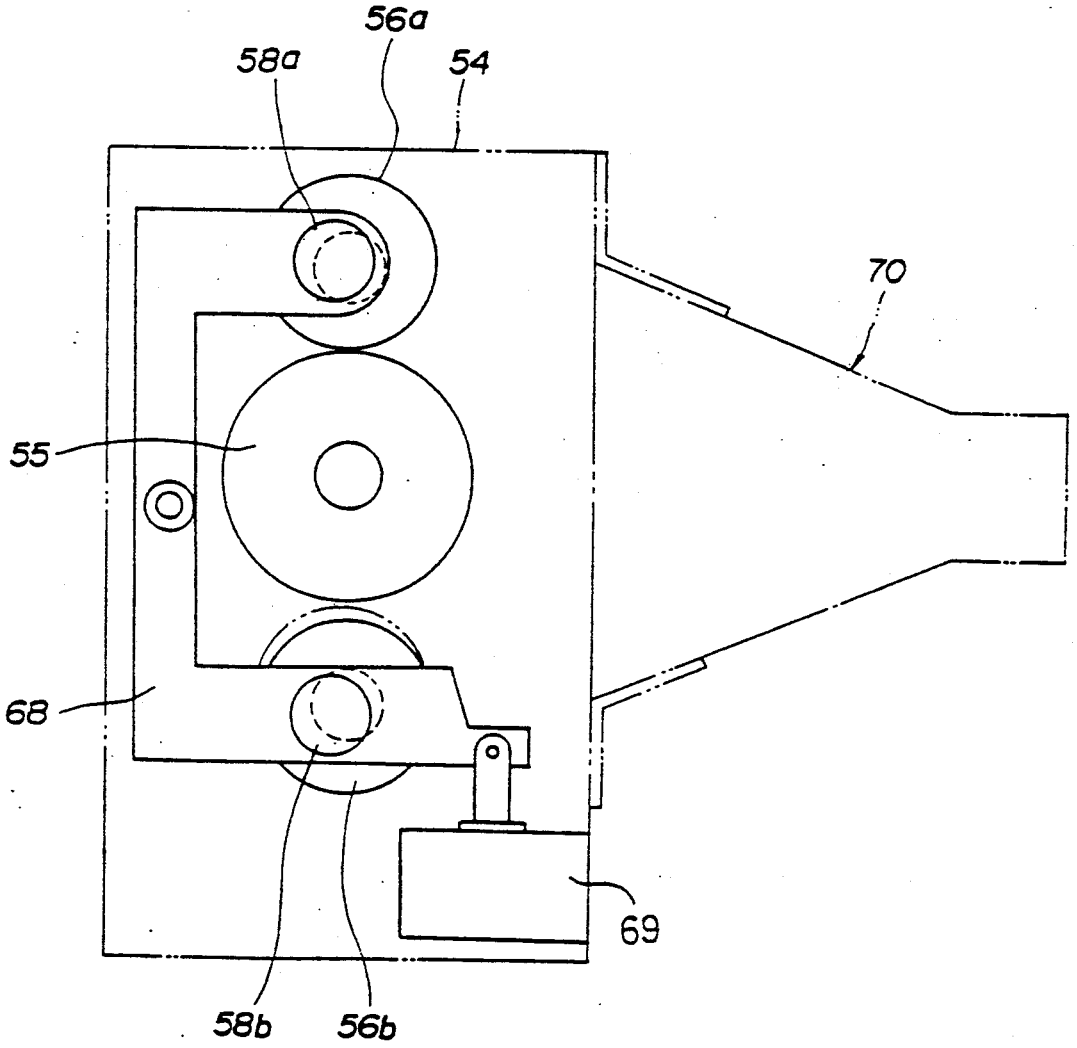

Referring now to FIGS. 1(A) and 1(B), pool roller 55 not only functions as a conventional pool roller for feeding a first band from a first band reel in a first or normal direction to accumulate a predetermined amount of band in the pool box 2, but also functions to rotate in a second or reverse direction to draw band out of the pool box 2 and the band remaining in the band guiding arm 4 through the pool box 2 at the time of the completion of the final strapping step associated with an empty supply reel. Pool roller 55 also rotates in the first direction to feed the band from the band coil 13 of the second or replacement band reel to the band guide 72 through the pool chute 70 when the first reel is empty.

Pool unit 30 includes pool roller 55 and pool touch rollers 56*a* and 56*b* that are reversibly rotatably mounted in roller chute 54 having two band passages 60*a* and 60*b* formed therein, and the pool roller 55 is coupled to a reversibly rotatable motor through a belt, not shown, wound on a pulley 57 that is rotatably driven.

The pool touch rollers 56*a* and 56*b* are mounted on eccentric shafts 58*a* and 58*b*, respectively, and are biased by a spring, not shown, toward the pool roller 55. Solenoid 69 is coupled to a pivotally mounted link 68 having its opposite ends mounted on the eccentric shafts 58*a* and 58*b* so that only one pool touch roller 56*a* or 56*b* is in rolling contact with pool roller 55 at any moment in time. The sides of the pool roller 55 and the pool touch rollers 56*a*, 56*b* are coated with a suitable substance, not shown, to increase the respective gripping abilities thereof. The pool roller 55 and touch rollers 56*a* and 56*b* brought into separable pressure contact with the upper and lower circumferential surfaces thereof, respectively, are eccentrically supported within a circular aperture that is slightly larger than the circumferences of the touch rollers 56*a*, 56*b*.

The pool chute 70 is formed by Y-band passages 65*a*, 65*b* and 65*c* (FIG. 1(A)). One passage 65*c* is disposed in cooperative alignment with the pool box, and passages 65*a*, 65*b* are secured to roller chute 54 in cooperative alignment with the outlets of band passages 60*a*, 60*b*.

Band absence detecting means 80 is disposed in band passage 65. More particularly, operating lever 83 of a limit switch 81 is inserted through bore 82 that is confluent with band passage 65*c*, and the lower end of the operating lever 83 overlies the bottom of the band passage 65*c*.

Lock chutes 71*a* and 71*b* are disposed at the respective inlets of the two band passages 60*a* and 60*b* of the roller chute 54. The lock chutes 71*a* and 71*b* have therein band passages 74*a* and 74*b*, which communicate with the band inlets of the band passages 60*a* and 60*b*. A band end gripping mechanism includes solenoids 76*a* and 76*b* having plungers 75*a* and 75*b* which extend into band passages 74*a* and 74*b*, respectively, through appropriate bores formed in the upper and lower surfaces of the lock chutes 71*a* and 71*b*.

Solenoids 76*a* and 76*b* are selectively operated by band end detection signals from the band reels 40*a* and 40*b*, as will be described later. The plunger of the activated solenoid retains the end of its associated band in band passage 74*a* or 74*b* and releases it after a predetermined short period of time. The retention is accomplished by tightly sandwiching the band end between its associated plunger and its band passage wall.

Referring again to FIGS. 2(A) and 2(B), band end detecting means 91*a* and 91*b* have the same arrangements and include reel chutes 90*a* and 90*b*, and limit switches 91*a* and 91*b* disposed forwardly of the band feeding directions of the band guide rollers 24*c* and 24*d*. The reel chutes 90*a* and 90*b* have formed therein band passages 92*a*, and the limit switches 91*a* or 91*b* disposed in the vicinity of the operating levers 83*a* and 83*b* are secured to brackets 94*a* and 94*b* in the band passage 92*a*. When the end of the band passes the operating lever 83, limit switch 91*a* or 91*b* closes and generates a signal indicating the end of the band. The solenoids 76*a* or 76*b* of lock chute 71*a* or 71*b* are activated upon receipt of said detection signal and remain activated for a predetermined short period of time so that the band end is captured before it enters pool box 2 under the inertia of the pool roller 55.

The arrangements of the pool roller and the touch rollers are not limited to the above-described embodiment. For example, two pairs of rollers used in a known feed unit in which a pair of touch rollers are separably operated alternatively in a see saw manner may be employed. In addition, arbitrary modifications in design of the invention may also be executed within the spirit and scope of the invention.

The Path of Travel

In FIG. 1(A), it will there be seen that the bands fed from the band reels 40*a* and 40*b* are passed via the free slide rollers 51*a* and 52*b* through the band guide rollers 24*a* and 24*b*, respectively. Then, the bands are passed through the band passages 92*a* and 92*b* of the reel chutes 90*a* and 90*b*, and, in turn, passed from the band guide rollers 24*c* and 24*d* through the band passages 74*a* and 74*b* in the lock chutes 71*a* and 71*b*. Further, the leading end of the band from band reel 40*b* is disposed in band passage 60*b* between the pool roller 55 and the touch roller 56*b*.

The leading end of the band of band reel 40*a* is fed through band passage 60*a* and band passage 65*a* of the pool chute 70 to the feed roller 31, circulated through the band guiding arch 4, and a predetermined amount of band is accumulated in the pool box 2 of the pool unit 30 and the feed unit 3. The predetermined amount is the length of the band at least necessary for one strapping step, said length being determined by calibrating the balance bar 7 and the limit switch to measure the length of one circumference or more of the band guiding arch 4.

Operation

As described above, when the band drawn from the band coil 13*a* of band reel 40*a* is used up and the trailing end of the band passes through the reel chute 90*a*, limit switch 91*a* of the band end detecting means of said reel chute 90*a* is activated and generates a band end detection signal. The solenoid 76*a* of the lock chute 71*a* (FIG. 1(A)) is energized by the detection signal, and the band trailing end is momentarily held in band passage 74*a* of lock chute 71*a*. Simultaneously, the reversible motor of the pool roller 55 is stopped by the band end detection signal to stop rotation of the pool roller 55. Thus, the band end is not introduced into the pool box by the rotating inertia of pool roller 55.

When a supply reel becomes empty, the strapping machine may be disposed at any of the predetermined strapping steps such as gripping the leading end of the band, returning the band, tightening it, cutting the trailing end of the band, melting the band superposed part, and feeding the band into the band guiding arch by the feed roller 31.

Since an amount of band sufficient to perform a single strapping step is accumulated in the pool box, the final strapping procedure is not interrupted. For example, if a complete strapping procedure had just been completed when the band end was detected, i.e., when the first supply reel became empty, the amount of band stored in the pool box will be sufficient to perform one complete strapping operation. If a strapping procedure were one-half completed when the band end was detected, then the completion of that step would require only one-half the band in the pool box. Excess band is removed from the pool box by reverse rotation of the pool roller as described herein.

After the strapping step performed with the band stored in the pool box for that purpose has been completed, the conveyor line is briefly stopped, and the following band reel replacing and band loading steps are conducted.

The trailing end of the band is released by the solenoid upon expiration of a predetermined short period of time (a period from the generation of the band end detection signal to the stopping of the rotation of the pool roller). Upon expiration of said predetermined time, pool roller 55 is reversibly driven to pull band in pool box 2, or in both pool box 2 and band guiding arch 4, out of the pool box, said band being excess band, i.e., band not required to complete the strapping step conducted after detection of the trailing end of the band. When the trailing end of the excess band drawn from the pool box travels through the absence detecting means 80 (left side of FIG. 1(A)), thereby indicating that the pool box is empty, the reverse rotation of pool roller 55 is stopped and band guide 72 is moved into its "in" position. Balance bar 7 will also detect that the pool box is empty and generate a "box empty" signal. Simultaneously, solenoid 69 (FIG. 1(B)) is energized by the band absence detection signal generated by detecting means 80, and link 68 is pivoted about pivot point 67 to disengage touch roller 56*a* from pool roller 55, and to engage touch roller 56*b* and pool roller 55, thereby engaging the leading end of the replacement band, said leading end having been previously positioned between pool roller 55 and touch roller 56*b*.

Pool roller 55 is then again driven in its normal or forward rotation to feed the leading end of the replacement band from band reel 40*b* between pool roller 55 and touch roller 56*b* in band passage 74*b* of the lock chute 71*b* and hence through the band passage 60*b* of the roller chute 54 toward the pool box. This rotation of the pool roller is caused by the "box empty" signal generated by the limit switch of the balance bar that is activated when the pool box becomes empty.

An air cylinder, not shown, coupled to lever 73 of the band guide 72 (see FIGS. 3 and 4) is operated by the band absence detection signal of the pool chute 70 to dispose the band guide 72 at its "in" or band guiding position, as aforesaid, which position is between the passage 65*c* (left side of FIG. 1(A)) and the arm chute 6 of the tension arm 5 (FIG. 5). In other words, band guide 72 is placed into its band guiding position only when the pool box is emptied by the reverse rotation of the pool roller, i.e., only when excess band has been ejected from the machine, and the leading end of the replacement band is to be guided to the feed unit of the machine. Means for confirming that the band guide 72 is disposed at the band guiding or "in" position generates a detection signal, and the feed roller 31 of feed unit 3, which had stopped rotation to allow completion of the strapping step performed with the band stored in the pool box, resumes rotation in a band feeding direction upon receipt of said signal. The replacement band, fed by pool roller 55 and touch roller 56*b*, is fed through band guide 72 to the arm chute 6 and from there to the feed roller 31. The band is circulated around the band guiding arch 4 by the rotating feed roller 31, until the leading end of the band arrives at mechanism 9 for gripping said band leading end. The amount of band now in arch 4 is sufficient to strap a package. An unillustrated means is provided at feed roller 31 for detecting that the leading end of the band has arrived at said feed roller 31 and said unillustrated means generates a detection signal. The band guide 72 is removed from its band guiding position upon receipt of said detection signal and returned to its retracted position. The conveyor line is also restarted at that time and a package is strapped with the band in arch 4. A signal is generated to indicate that the guide 72 has resumed its retracted position; this signal causes the pool roller 55 to resume its forward rotation. The replacement band is then fed into the pool box by said forward rotation of the pool roller 55 and the corresponding rotation of touch roller 56*b*, because band guide 72 is no longer disposed in its band guiding position. When the band is accumulated in the predetermined amount, as detected by the "box full" limit switch of the balance bar 7 (FIG. 3) which is slidably provided under the pool box 2, rotation of the pool roller 55 is stopped. The reel change is then fully completed. Feed roller 31 is activated, pool roller 55 rotates in its first direction to maintain band in the pool box, and the machine resumes its normal strapping operation. At no time has human intervention been required to change the reel.

An operator who observes that replacement band reel 40*b* is in use, whether such observation is made by observing a display lamp provided above the strapping machine body 1, or by noting the end detection signal or by direct visual observation from a centralized supervising chamber, loads a new band coil 13*a* onto band reel 40*a*, and inserts the leading end of the band sequentially through band passages 71*a* and 60*a* into position between touch roller 56*a* and pool roller 55.

Importantly, the human operator replaces the empty reel with a full reel after the machine has automatically switched from one reel to the other. Thus, the operator may replace the reel at his or her leisure because the machine is operating while the new reel is being installed.

SUMMARY OF OPERATION

There are a total of seven sensors or detectors in the novel system, each of which generates at least one signal that activates a mechanism.

The first sensor is the band end detecting means in the reel chute; it activates the solenoid that momentarily grabs the trailing end of a band as it leaves a reel. It also stops forward rotation of the pool roller for a predetermined period of time. The final strapping step, performed with band accumulated in the pool box, is performed during that period of time. At the expiration of that period of time, the solenoid releases its grip and the pool roller begins rotating in a reverse direction and ejects the excess band from the machine.

As the band is ejected from the machine, a second sensor in the pool chute detects its trailing end and generates a signal. This signal activates that air cylinder that moves band guide 72 into its operative deployment. It also stops the reverse rotation of the pool roller and toggles the touch rollers so that the leading end of the replacement band is engaged. Moreover, it stops rotation of feed roller 31 in the unit 3.

A third detector in balance bar 7 simultaneously detects that the pool box is empty and generates a "box empty" signal that causes the pool roller to again rotate forwardly.

When the band guide 72 is in its deployed, or "in" position, a fourth detector generates a signal that restarts feed roller 31 in feed unit 3.

The leading end of the replacement band is then guided directly through the band guide arch of the machine. When said leading end arrives at mechanism 9, a fifth detector at that location generates a signal that causes retraction of band guide 72 and stops rotation of feed roller 31 and pool roller 55. That signal also re-starts the conveyor line and re-starts the machine so that an article is strapped by the band in arch 4.

When the band guide 72 is retracted, it activates a sixth detector and that detector sends a signal that starts the pool roller rotating in a forward direction again, thereby accumulating band in the pool box.

When the pool box is full, a "box full" signal generated by a seventh detector in the pool box stops forward rotation of the pool roller momentarily and then re-starts said pool roller and feed roller 31 simultaneously so that regular operation of the machine resumes. Theoretically, the pool roller does not need to stop momentarily upon he pool box becoming full; instead, the feed roller could start up at that time and the result would be the same.

The following table further summarizes the operation of the novel machine:

| DE-TECTOR | LOCA-TION | WHAT DETECTED | SIGNAL GOES TO | EFFECT OF SIGNAL |
|---|---|---|---|---|
| 1 | lock chute | trailing end of band leaving supply reel | 1. solenoids 76a, 76b<br>2. pool roller motor | 1. solenoid grabs trailing end of band<br>2. motor stops and pool roller coasts to stop<br>3. after predetermined time, pool roller reverses rotation |
| 2 | pool chute | trailing end of band leaving pool box | 1. air cylinder that controls band guide 72<br>2. pool roller motor<br>3. solenoid 69 | 1. air cylinder activated and band guide 72 goes "in"<br>2. pool roller stops reverse rotation<br>3. touch rollers toggle and leading end of replacement band engaged |
| 3 | pool box | "pool box empty" | pool roller motor | pool roller rotates in forward direction; replacement band travels through band guide 72 to feed unit, bypassing pool box |
| 4 | band guide 72 | "band guide in" | motor of feed roller 31 | feed roller begins rotating to feed leading end of band through arch and predetermined station (mechanism 9) |
| 5 | mechanism 9 | leading end of replacement band in position | air cylinder that controls band guide 72 | 1. retract band guide 72<br>2. stops pool roller<br>3. stops feed roller 31<br>4. conveyor line re-starts and article is strapped by band in arch |
| 6 | band guide 72 | "band guide out" | pool roller motor | pool roller rotates in forward direction; replacement band begins accumulating in pool box because feed roller is not operating |
| 7 | pool box | "pool box full" | motor of feed unit | feed roller 31 re-starts and machine operates normally |

The exact location of these sensor elements is not absolutely critical in all cases. Moreover, the exact instructions sent by the various signals may e varied. The various functions performed by the sensors can also be shared with other sensors, or different sensors can perform different functions. For example, the balance bar "box empty" signal causes the pool roller to rotate forwardly. However, the band guide 72 "in" signal could also be employed to start the pool roller rotating forwardly. Clearly, any simultaneously sent signals could be generated and sent by differing detectors. Thus, the broadest claims that follow are not directed to a machine that is configured in a specific way. Instead, said broadest claims are intended to protect the heart or essence of this breakthrough invention.

This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A method of automatically replacing a band reel and loading a band comprising the steps of:

gripping a band trailing end in a lock chute near a roller chute according to a band end detection signal of one of a plurality of band reels;

stopping a pool roller;

releasing said trailing end upon the expiration of a predetermined period of time;

reversely rotating the pool roller after said gripping is released, thereby removing said band from a pool box;

stopping the reverse rotation of the pool roller by a band absence detection signal when the band trailing end passes the lock chute and the removal of the band from the pool box is finished;

removing a first touch roller from pressure contact with the pool roller;

bringing a replacement band previously positioned between a second touch roller and the pool roller into pressure contact with the pool roller and the second touch roller;

rotating the pool roller in a forward direction for feeding the replacement band into the pool box;

positioning a band guide from a band outlet of the pool chute communicating with the roller chute to a band guiding position according to said band absence detection signal thereby preventing said replacement band from entering said pool box;

delivering a leading end of said replacement band to a feed unit through the band guide;

removing the band guide from said band guiding position according to a band presence detection signal of a feed unit; and again rotating the pool roller in said forward direction for feeding the replacement band into the pool box.

2. A method for strapping packages with a flexible band, comprising the steps of:

providing at least a pair of rotatably mounted reel members, each of which carries a predetermined length of said band in coiled relation thereabout;

providing a rotatably mounted pool roller and a pair of rotatably mounted touch rollers;

positioning a first touch roller into operative engagement with said pool roller and positioning a second touch roller in spaced apart relation to said pool roller;

providing a band guide member having a band guiding position and a retracted position;

providing a pool box into which a predetermined length of said band is accumulated when said pool roller is rotating in a first direction and when said band guide member is in said retracted position;

operating said strapping machine until the first reel member is empty;

stopping rotation of said pool roller when said first reel member is empty;

substantially simultaneously grabbing a trailing end of band from said first reel member after it has been unreeled from said first reel member and before it has entered said pool box;

performing a strapping operation with band accumulated in said pool box;

releasing said trailing end after the expiration of a predetermined period of time;

rotating said pool roller in a second, opposite direction, relative to said first direction, to remove from the pool box any band not used in said strapping operation;

positioning said band guide member into its band guiding position only when all of the band has been removed from said pool box;

substantially simultaneously removing said first touch roller from its engagement with said pool roller and placing said second touch roller into operative engagement with said pool roller;

rotating said pool roller in its first direction to feed replacement band from a second reel member through said band guide member through a band guide arch of said machine and then to a feed unit of said machine;

retracting said band guide member when a leading end of said replacement band from said second reel member arrives at said feed unit;

simultaneously re-starting a conveyor line and strapping an article, carried by said conveyor line, with the replacement band in said band guide arch;

rotating said pool roller in said first direction to accumulate a predetermined amount of replacement band in said pool box;

operating said machine until the second reel member is empty;

grabbing the trailing end of the replacement band of said second reel member after it has unreeled from said second reel member and before it has entered said pool box; and repeating the appropriate steps of the method as set forth in connection with said first reel member.

3. An automatic band reel replacing and band loading apparatus, comprising:

a reel unit having a plurality of band reels;

band end detecting means associated with each band reel of said plurality of band reels;

a roller chute having a plurality of band end gripping means for gripping a band trailing end for a predetermined period of time according to a detection signal of said band end detecting means;

a pool roller reversibly rotatably driven in said roller chute;

a plurality of touch rollers selectively separably brought into pressure contact with said pool roller, wherein bands of different band reels are selectively fed in a first, pool box direction between the touch rollers and the pool roller;

means for rotatably driving the pool roller, after the gripping of the band trailing end is released, in a second, opposite direction relative to said first direction;

a band guide for guiding the band, when said band guide is in a band guiding position, through a band guide arch to a feed roller of a feed unit;

signal generating means for confirming that the band guide is disposed at said band guiding position;

said band guide being inserted to the band guiding position by a detection signal from band absence detecting means provided in said pool chute;

said pool roller being rotatably driven in said first direction according to a band guiding position confirmation signal of said band guide; and said band guide being retracted from its band guiding position by a detection signal of a band presence detecting means provided in said feed unit.

4. An automatic band reel replacing and band loading apparatus according to claim 3, wherein each of said pool touch rollers is eccentrically mounted to opposite ends of a link member, and wherein only one of said touch rollers is always in pressure contact with the pool roller in two band passages of said roller chute.

5. An automatic band reel replacing and band loading apparatus according to claim 4, wherein said link member is coupled to a solenoid, and wherein one of said two touch rollers is alternately brought into separable pressure contact with the pool roller upon activation of said solenoid.

6. An automatic band reel replacing and band loading apparatus according to claim 3, further comprising a Y-shaped band passage formed in said pool chute, said Y-shaped band passage being confluent with two band passages positioned at a band outlet side of said roller chute.

7. An automatic band reel replacing and band loading apparatus according to claim 3, wherein said band trailing end gripping mechanism is provided at the band outlet side of said roller chute, and includes a solenoid having a plunger disposed in the vicinity of the band passage of the lock chute having two band passages communicating with the two band passages of said roller chute.

8. An automatic band reel replacing and band loading apparatus according to claim 3, wherein said band end detecting means further comprises a limit switch disposed in the vicinity of a lever in the band passage of the reel chute having the band passage disposed in front of a band feeding direction near a plurality of band reels.

9. In a band strapping machine, comprising:

means for detecting a trailing end of a band as said band is uncoiled from a first supply reel, said means for detecting being operative to generate a first signal when said trailing end of said band is detected;

means for grabbing said trailing end so that said band is not introduced into a pool box;

means for removing excess band from said pool box and for ejecting said excess band from the machine;

means for detecting a trailing end of said excess band as it is ejected from the machine, said means for detecting said trailing end of said excess band being operative to generate a second signal when said excess band trailing end is detected; and means for engaging a leading end of a replacement band coiled about a second supply reel;

said means for engaging being activated by said second signal.

10. In the machine of claim 9, further comprising:

band guide means for guiding said leading end of said replacement band through a band guide arch of said machine to a feed unit of said machine;

said band guide means having a retracted, inoperative, non-band guiding position and an extended, operable, band guiding position;

placed into its band said band guide means being guiding position in response to receipt of said second signal.

11. In the machine of claim 10, further comprising means for accumulating a predetermined amount of said replacement band in a pool box after said excess band has been removed from said pool box by said means for removing.

12. In the machine of claim 11, further comprising detector means associated with said pool box for detecting when said pool box is empty, said means for detecting when said pool box is empty being operative to generate a third signal, and said means for accumulating a predetermined amount of said replacement band in said pool box being activated upon receipt of said third signal.

13. In the machine of claim 12, further comprising means for detecting when said band guide means is in its band guiding position, said means for detecting when said band guide means is in its band guiding position being operative to generate a fourth signal.

14. In the machine of claim 13, further comprising means for feeding said leading end of said replacement band to a specific predetermined position within said feed unit, said means for feeding being activated upon receipt of said fourth signal.

15. In the machine of claim 14, further comprising means for retracting said band guide means when said leading end of said replacement band arrives at said specific predetermined position, a detector means being positioned at said specific predetermined position, said detector means being operative to generate a fifth signal when it detects that said replacement band leading end has attained said specific predetermined position, said means for retracting said band guide means being activated upon receipt of said fifth signal, and said fifth signal being operative to re-start a conveyor line and to cause the strapping of an article, carried by said conveyor line, with the replacement band in said band guide arch.

16. In the machine of claim 15, further comprising retraction detecting means for detecting when said means for retracting said band guide means has retracted said band guide means, said retraction detecting means being operative to generate a sixth signal, and said sixth signal re-activating said means for accumulating.

17. In the machine of claim 16, further comprising band presence means for detecting when said predetermined amount of replacement band has accumulated in said pool box, said band presence means being operative to generate a seventh signal and said seventh signal being operative to restore said machine to a normal operating mode.

* * * * *